US007862007B2

(12) United States Patent
Schlegl et al.

(10) Patent No.: US 7,862,007 B2
(45) Date of Patent: Jan. 4, 2011

(54) LIGHTWEIGHT VALVE

(75) Inventors: Martin Schlegl, Rudersberg (DE); Holger Stark, Allmersbach (DE)

(73) Assignee: Daimler AG, Stuttgart (DE)

( * ) Notice: Subject to any disclaimer, the term of this patent is extended or adjusted under 35 U.S.C. 154(b) by 576 days.

(21) Appl. No.: 10/579,284

(22) PCT Filed: Nov. 4, 2004

(86) PCT No.: PCT/EP2004/012448

§ 371 (c)(1),
(2), (4) Date: Jul. 14, 2008

(87) PCT Pub. No.: WO2005/049979

PCT Pub. Date: Jun. 2, 2005

(65) Prior Publication Data

US 2008/0272325 A1 Nov. 6, 2008

(30) Foreign Application Priority Data

Nov. 19, 2003 (DE) ..... 103 54 086

(51) Int. Cl.
*B22D 41/16* (2006.01)

(52) U.S. Cl. ..... 251/356; 123/188.3

(58) Field of Classification Search ..... 251/356, 251/366; 123/188.2, 188.3, 41, 41.34; 29/888.45
See application file for complete search history.

(56) References Cited

U.S. PATENT DOCUMENTS

| | | | | |
|---|---|---|---|---|
| 1,506,900 A | | 9/1924 | Greiner et al. | |
| 1,727,621 A | | 9/1929 | Taub | |
| 2,439,240 A | | 1/1945 | Cummings | 123/188 |
| 2,371,548 A | | 3/1945 | Saffady | 123/177 |
| 2,407,561 A | * | 9/1946 | Rush | 123/188.3 |
| 3,156,259 A | | 11/1964 | Havelka et al. | 137/516.23 |
| 3,395,747 A | | 8/1968 | Thompson | 164/95 |
| 3,503,375 A | | 3/1970 | Thompson | 123/188.3 |
| 3,911,875 A | * | 10/1975 | Ysberg | 123/41.34 |
| 4,513,701 A | | 4/1985 | Sternberg et al. | 123/188.3 |
| 4,834,036 A | * | 5/1989 | Nishiyama et al. | 123/188.2 |
| 5,044,604 A | | 9/1991 | Topham et al. | 251/120 |
| 5,054,195 A | * | 10/1991 | Keck et al. | 29/888.453 |
| 5,345,965 A | | 9/1994 | Blume | 137/533.25 |
| 5,413,073 A | * | 5/1995 | Larson et al. | 123/188.3 |
| 5,458,314 A | | 10/1995 | Bonesteel | 251/337 |
| 5,823,158 A | * | 10/1998 | Heimann et al. | 123/188.3 |
| 6,009,843 A | | 1/2000 | Griffin et al. | 123/188.3 |
| 6,263,849 B1 | * | 7/2001 | Bonesteel et al. | 123/90.51 |

(Continued)

FOREIGN PATENT DOCUMENTS

AT 005 131 U1 3/2002

(Continued)

*Primary Examiner*—John K Fristoe, Jr.
*Assistant Examiner*—Marina Tiet Jen
(74) *Attorney, Agent, or Firm*—Davidson, Davidson & Kappel, LLC

(57) ABSTRACT

A lightweight valve (1), in particular for internal combustion engines, is provided, with a valve stem (3), with a hollow valve cone (5) and with a valve disk (7) closing the valve cone hollow space on one side, a valve cone support being provided in the hollow space. The valve cone support is provided at a distance from the valve disk (7).

15 Claims, 2 Drawing Sheets

U.S. PATENT DOCUMENTS

| | | | | |
|---|---|---|---|---|
| 6,354,258 | B1 | 3/2002 | Abele et al. | 123/188.3 |
| 6,935,296 | B2 | 8/2005 | Abele et al. | 123/188.3 |
| 6,938,602 | B2 | 9/2005 | Hora et al. | 123/188.3 |
| 2007/0125976 | A1 | 6/2007 | Stark et al. | 251/120 |
| 2007/0145322 | A1 | 6/2007 | Stark et al. | 251/356 |

FOREIGN PATENT DOCUMENTS

| | | | |
|---|---|---|---|
| DE | 32 33 392 | | 3/1984 |
| DE | 36 25 590 | | 2/1988 |
| DE | 197 31 382 | | 1/1999 |
| DE | WO9905397 | * | 2/1999 |
| DE | 198 04 053 | | 8/1999 |
| DE | 100 29 299 | C1 | 3/2003 |
| DE | 102 04 122 | C1 | 5/2003 |
| DE | 101 60 942 | | 6/2003 |
| DE | 102 57 505 | | 7/2003 |
| EP | 0 296 619 | | 12/1988 |
| EP | 709 552 | | 5/1996 |
| EP | 1 359 292 | | 11/2003 |
| FR | 2 071 137 | | 9/1971 |
| FR | 2 540 176 | | 8/1984 |
| GB | 476089 | | 12/1937 |
| GB | 1 405 606 | | 9/1975 |
| GB | 2 137 279 | | 10/1984 |
| JP | 58-142204 | | 10/1981 |
| JP | 8-210112 | A | 9/1992 |
| JP | 4-269312 | A | 8/1996 |
| JP | 2000-045730 | | 2/2000 |
| WO | WO 98/36159 | | 8/1998 |

* cited by examiner

LIGHTWEIGHT VALVE

The invention relates to a lightweight valve, in particular for internal combustion engines, with a valve stem, with a hollow valve cone and with a valve disk closing the valve cone hollow space on one side, valve cone-supporting means being provided in the hollow space.

BACKGROUND

Lightweight valves of the kind referred to here are known (DE 19 804 053 A1). They are used inter alia as inlet and outlet valves for internal combustion engines and comprise a valve stem which is adjoined by a funnel/trumpet-shaped valve cone. For the purpose of weight reduction, the valve cone is hollow and has only a small wall thickness. The valve cone is closed at its end of greater diameter by means of a valve disk. According to one variant embodiment (figures four and five of DE 19 804 053 A1), the valve cone is formed by a separate sheet-metal component which is welded together with the valve stem and the valve cone. For this, the end of greater diameter of the valve cone is positioned with its end face opposite an annular surface located on that flat side of the valve disk facing the valve cone. Accurate alignment of valve cone and valve disk in relation to one another is extremely difficult owing to the only small bearing contact surfaces of these parts. Moreover, the weld seam formation possibilities in the regions of connection of the valve cone to the valve disk and the valve stem are limited.

As, in the lightweight valve mentioned above, the valve disk is not supported on a large area owing to the hollow space in the valve cone and the valve cone moreover has only a small wall thickness, the valve disk may be deformed during operation by the combustion pressure in the combustion chamber of the internal combustion engine, which contributes to premature wear of the lightweight valve. Furthermore, the thin-walled valve cone may also be deformed. In order to prevent this, DE 198 04 053 A1 proposes making the valve stem so long that it rests with its end face on that flat side of the valve disk facing away from the combustion chamber, by virtue of which the disk is supported. In this connection, the valve stem, which is hollow or made of solid material, and the valve disk can be welded together in their contact region. An alternative proposal is to manufacture the valve stem and the valve disk in one piece, that is as one part. In other alternatives, the valve disk is supported against the valve stem by means of an intermediate piece designed in one piece on the valve cone or a separate sleeve fixed between valve stem and valve disk. It is a disadvantage of the known lightweight valve that its individual parts can in some cases be produced only in a costly way owing to their geometry which is defined by the construction concerned and that accurate alignment of the individual parts in relation to one another before the joining process can be brought about only with high outlay.

A lightweight valve in which the hollow valve cone is formed on the valve stem end and in which means for supporting the valve cone and the valve disk are provided which are formed by reinforcing ribs arranged in the valve cone hollow space is disclosed by U.S. Pat. No. 2,439,240. The reinforcing ribs also improve the heat dissipation from the valve disk. The reinforcing ribs are designed in one piece on the valve disk or the valve cone or are alternatively inserted as a separate supporting framework into the valve cone hollow space.

SUMMARY OF THE INVENTION

An object of the invention is to provide an alternative to the lightweight valve of the kind referred to in the introduction.

The present invention provides a lightweight valve with a valve stem, with a hollow valve cone and with a valve disk closing the valve cone hollow space on one side, valve cone-supporting means being provided in the hollow space. This is characterized in that the valve cone-supporting means are provided at a distance from the valve disk. In addition to their actual function, namely supporting the hollow, thin-walled valve cone, the supporting means have a further function, namely accurate arrangement of the valve cone—seen in the direction of the longitudinal central axis of the lightweight valve—in the axial direction relative to the valve disk. The design and arrangement of the supporting means relative to the valve disk are preferably selected in such a way that, when the lightweight valve has been properly joined together, the valve cone is by way of the supporting means arranged at an axial distance measured in the direction of the longitudinal central axis of the valve stem, or of the lightweight valve, in relation to the valve disk in such a way that the joint surfaces of the valve disk and of the valve cone in their connection region are arranged in a desired way in relation to one another in order that they can subsequently be interconnected—preferably by means of material connection—without further alignment.

In an advantageous illustrative embodiment of the lightweight valve, the valve cone-supporting means are designed in one piece with the valve stem. The means can be formed on the valve stem and formed by a thickening, that is a partial diameter widening of the valve stem, for example. Here, the valve cone is pushed onto the valve stem and by displacement in the axial direction comes into bearing contact with the supporting means, which therefore serve as a stop for the valve cone. In a preferred embodiment, the valve stem is with its end face in bearing contact with the valve disk, so that the latter is supported by the valve stem on its flat side facing away from the combustion chamber. The gas forces acting on the valve disk during operation of the lightweight valve are therefore at least for the most part introduced into the valve stem.

According to another embodiment, the valve cone-supporting means are designed on a stem connection element which is formed on or fastened to the valve disk and projects in a dome-like manner above the flat side facing the valve cone. In this connection, the stem connection element connecting the valve disk to the valve stem is in its simplest embodiment designed as a pin which is provided with a thickening, that is a longitudinal portion of greater diameter. In this embodiment, the valve cone is pushed onto the stem connection element which is preferably arranged in the center of the valve disk. In this connection, the supporting means fix the exact position of the valve cone relative to the valve disk and moreover support it. Owing to the connection of the valve disk to the valve stem via the stem connection element provided in its central region, optimum introduction of the gas forces acting on the valve disk during operation of the lightweight valve into the valve stem can be ensured without inadmissibly great deformations of the valve disk and of the preferably very thin-walled valve cone arising in this connection. It is therefore readily possible for the valve cone to be virtually force-free during operation of the lightweight valve, that is for only very small forces, if any, to be introduced into the valve cone via the valve disk. The valve cone can therefore be designed with very thin walls, which is advantageous in manufacture of the same and moreover contributes to reducing the weight of the lightweight valve.

In an advantageous illustrative embodiment, the valve disk with the stem connection element possibly provided thereon is made from the intermetallic phase titanium aluminide (TiAl) or a TiAl alloy by casting. This valve disk is of only light weight and is moreover extremely wear-resistant. According to another variant embodiment, the valve disk is made of steel, in particular tool steel, and is produced by forging. According to a third variant embodiment, the valve disk is manufactured by means of a powder metallurgy production process, in particular from a tool steel which is extremely wear-resistant.

As far as the materials which can be used for the valve stem and the valve disk are concerned, reference is also made to DE 100 29 299 C2, the content of which with regard to the materials used is a subject of this description.

In an especially preferred illustrative embodiment of the lightweight valve, the valve cone is designed as a sheet-metal component. High-carbon structural steel, in particular St-52, or low-alloy steel, in particular X10Cr13, for example, is used as the material. The valve cone can be produced cost-effectively by deep-drawing.

BRIEF DESCRIPTION OF THE DRAWING

Further advantageous illustrative embodiments of the lightweight valve emerge from combinations of the features referred to in the description and in the subclaims.

The invention is explained in greater detail below with reference to the drawing, in which.

DETAILED DESCRIPTION

Figure 1:
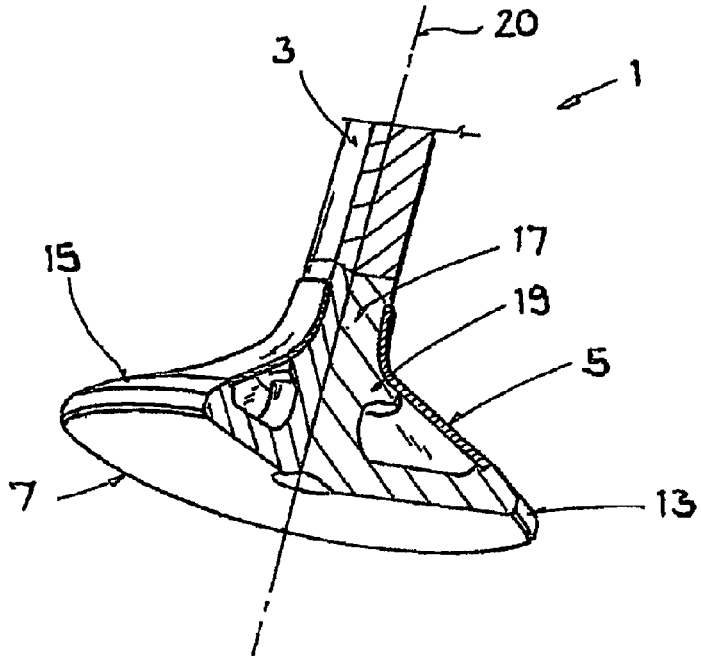
FIG. 1 shows a detail of a first illustrative embodiment of a lightweight valve for internal combustion engines in a perspective, cutaway illustration.

FIG. 1 shows a first illustrative embodiment of a lightweight valve 1 of multi-part design for internal combustion engines. This can be used as a thermally less loaded inlet valve or as a thermally more highly loaded outlet valve, the material of the individual parts being selected accordingly depending on the use of the lightweight valve 1.

The lightweight valve 1 (plug valve) illustrated in FIG. 1 comprises a valve stem 3, a hollow valve cone 5, formed by a sheet-metal component, and a valve disk 7 closing the valve cone 5.

The valve stem 3, which here is made of solid material for example, has a constant circular cross section over at least part of its length.

The valve disk 7 is provided on its flat side which faces away from the combustion chamber of the internal combustion engine during operation of the lightweight valve 1 with a recess 9 into which the valve cone 5 projects with its end of greater diameter, as can be seen from FIG. 1. In this connection, the recess 9 is designed in such a way that the transition between valve disk 7 and valve cone 5 in their connection region is continuous. The hollow space of the valve cone 5 is closed by means of the valve disk 7. In this illustrative embodiment, the bottom of the recess 9 is of plane design. The diameter of the recess 9 and the outside diameter of the valve cone 5 at its end of greater diameter are the same or approximately the same.

Figure 3:
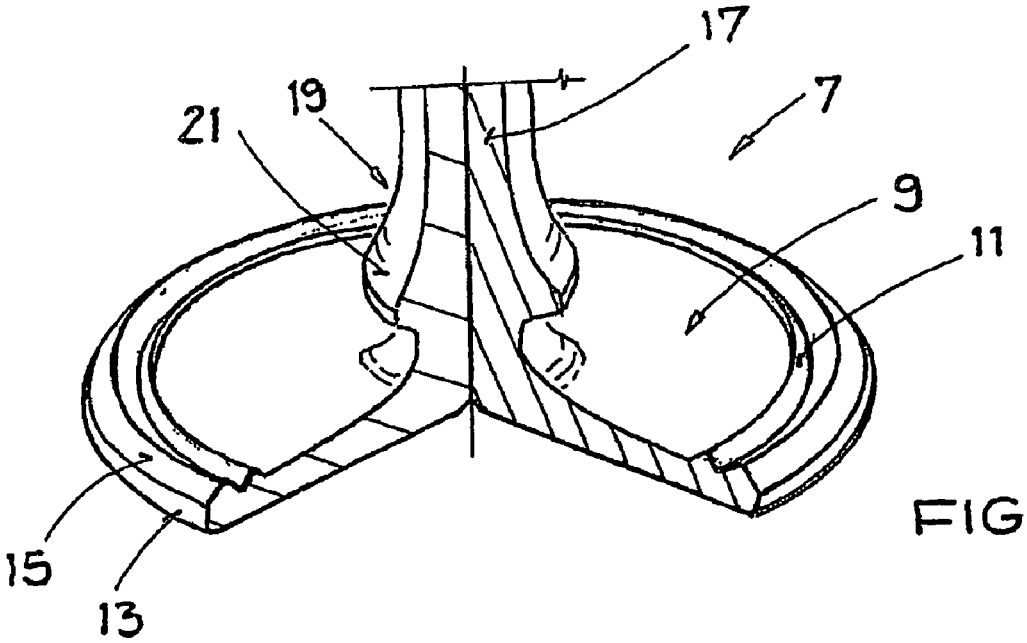
FIG. 3 shows an enlarged illustration of a valve disk of the lightweight valve illustrated in FIG. 1.

As can be seen from FIG. 3, which shows a detail illustration of the valve disk 7, the recess 9 has in its edge region an all-round edge step 11 which serves for supporting or as a bearing shoulder for the valve cone 5. In the assembled state of the lightweight valve 1, the end face 12, located at the end of greater diameter, of the valve cone 5 engaging in the recess 9 is in bearing contact with the edge step 11. The recess 9, or the edge step 11, forms a centering and supporting seat for the valve cone 5.

The valve disk 7 is of disk-shaped design and has a first, cylindrical longitudinal portion 13 of constant cross section and, adjoining this, a conical, that is frustoconical, second longitudinal portion 15, the cone angle of the second longitudinal portion 15 being the same as the cone angle of the valve cone 5 at its end of greater diameter, by virtue of which a continuous transition is brought about in the connection region between these parts, as illustrated in FIG. 1. The lateral surface of the longitudinal portion 15 usually forms the sealing surface of the lightweight valve 1.

The valve disk 7 has on its flat side having the recess 9 a stem connection element 17 which is designed in one piece with the valve disk 7 and is located in its center. The stem connection element 17 is at its free end connected to the valve stem 3, which can be effected by friction welding, for example. In this illustrative embodiment, the length of the stem connection element 17 is selected in such a way that, when the lightweight valve 1 has been assembled, the connection region between stem connection element 17 and valve stem 3 is arranged outside the valve cone hollow space. This design affords both the possibility of first connecting the valve cone 5 to the valve disk 7 and the stem connection element 17 and only then connecting the valve stem 3 to the valve disk 7 and also the alternative method variant of connecting the valve stem 3 to the stem connection element 17 in a first step and then connecting the valve cone 5 to the valve disk 7 and the stem connection element 17 in a second step.

The stem connection element 17 has in its region of connection to the valve stem 3 the same outside diameter and the same shape as the valve stem 3, by virtue of which a continuous transition can be brought about.

Means for partial internal support of the thin-walled valve cone 5 are provided on the stem connection element 17, which means are formed in this illustrative embodiment by a thickening 19 formed on the stem connection element 17 which—seen in the direction of the longitudinal central axis 20 of the lightweight valve 1—is located at an axial distance from the bottom of the recess 9, or of that flat side of the valve disk 7 facing the valve cone 5. The thickening 19 has a conical supporting surface 21 of all-round design in the illustrative embodiment according to FIG. 1, which is in bearing contact with an inner wall region 23 of the valve cone 5, by virtue of which the valve cone 5 is supported. The contour of the supporting surface 21 is designed to complement the inner wall region 23, by virtue of which contact of these surfaces over the entire surface can be ensured.

The distance of the thickening 19 from the valve disk 7 and its design are such that the valve cone 5 pushed onto the stem connection element 17 is both centered in relation to the valve disk 7 and held at such a distance from the valve disk 7 that the valve cone 5 projects into the recess 9, that is into the edge step 11, with its end of greater diameter in the desired way.

Figure 2:
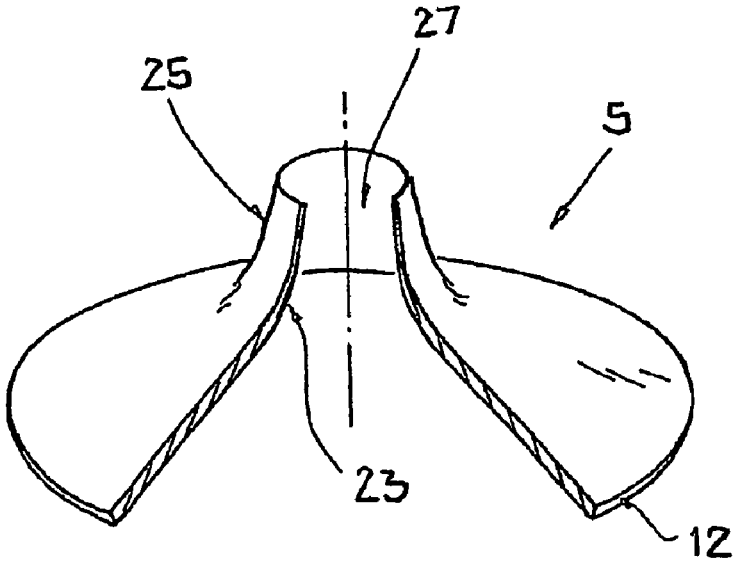
FIG. 2 shows an enlarged illustration of a valve cone of the lightweight valve illustrated in FIG. 1.

The valve cone 5 illustrated in FIGS. 1 and 2 has a funnel shape overall, which is formed by a basic body in the shape of a disk spring and a collar-shaped guiding and centering portion 25 adjoining the end of smaller diameter of the basic body, the guiding and centering portion 25 being perforated by a through-opening 27, through which the stem connection element 17 extends in the joined-together state. The diameter of the through-opening 27 is the same as or greater than the outside diameter of the stem connection element 17, so that either the latter extends through the through-opening 27 with play or a non-positive connection is formed between stem connection element 17 and valve cone 5. When the valve cone 5 is pushed onto the stem connection element 17, these parts are automatically aligned/centered in relation to one another radially relative to the longitudinal central axis 20 of the lightweight valve owing to the guiding and centering portion 25. Owing to the design described above of the lightweight valve 1, the valve cone 5 is also centered and moreover supported at its end of smaller diameter by means of the thickening 19. The support and centering of the valve cone 5 at its end of greater diameter is effected by means of the recess 9, or the edge step 11.

It remains to state that the valve cone 5 has a reduced wall thickness in the region of its guiding and centering portion 25, so that it as it were nestles against the outside of the stem connection element 17. By virtue of this, a transition between valve cone 5 and stem connection element 17 is brought about which has only a small step. In order to create a continuous transition in this region, the stem connection element 17 can have a corresponding taper on its outside in the region of its free end.

The valve cone 5 can be fastened to the stem connection element 17 by means of a material, non-positive and/or positive connection. In this respect, owing to the guiding and centering portion 25 and the supporting surface 21, there is an enlarged bearing contact area between valve cone 5 and stem connection element 17, which simplifies the joining of these parts overall. The valve cone 5 is preferably welded or soldered together with the stem connection element 17. The connection between valve cone 5 and valve disk 7 in their connection region, that is at the edge of the recess 9, is preferably also effected by means of a material connection.

The illustrative embodiment of the lightweight valve 1 described with reference to FIGS. 1 to 3 is characterized by small wall thicknesses of the individual parts, in particular of the valve cone 5, and consequently by only a small weight. It is furthermore advantageous that, by means of the stem connection element 17, not only is the valve cone 5 supported in regions but at the same time a desired alignment and positioning of valve cone in relation to valve disk also takes place. The gas forces acting on the valve disk 7 during operation of the lightweight valve 1 are advantageously introduced directly into the valve stem 3 via the centrally arranged stem connection element 17. Owing to the construction referred to above of the lightweight valve 1, the gas forces acting on the valve disk 7 are not, or are only to a harmless extent, introduced into the very thin-walled valve cone 5. Inadmissibly great deformation of the valve cone 5 can therefore reliably be excluded.

Figure 4:
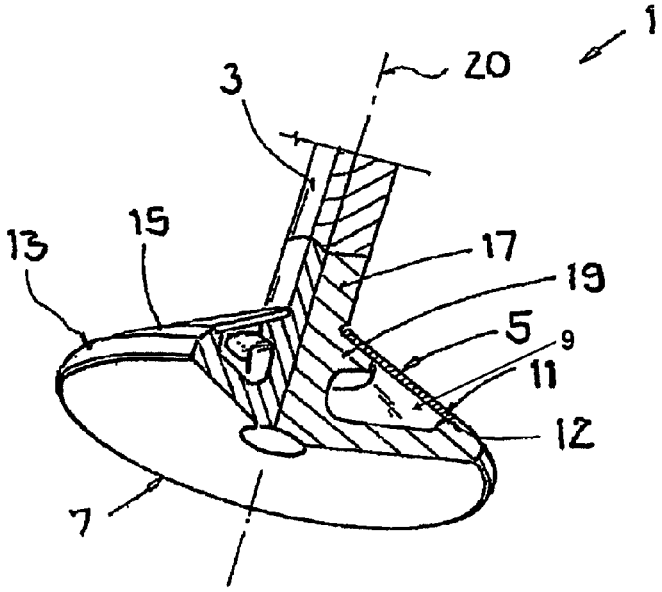
FIG. 4 shows a detail of a second illustrative embodiment of the lightweight valve in a perspective, cutaway illustration.

FIG. 4 shows a further illustrative embodiment of the lightweight valve 1. The same parts are provided with the same reference numbers, so that in this respect reference is made to the description for FIGS. 1 to 3. The fundamental difference is that the valve cone 5 has a simpler shape which is more cost-effective to produce, namely that of a disk spring. It is also advantageous that there is no step at the transition between valve cone 5 and valve stem 3, so that virtually no gas turbulence is generated at this location. Here, the centering of the valve cone 5 at its end region of smaller diameter is effected exclusively via the thickening 19 having the conical supporting surface 21.

It remains to state that the valve stem 3, the valve disk 7 and the stem connection element 17 can be made from the same material or from different materials. The connection between valve disk 7 and valve stem 3 via the stem connection element 17 can be effected by means of friction welding, beam welding, fusion welding or capacitor discharge welding. Connecting the extremely thin-walled valve cone 5 to the stem connection element 17 in the region of the guiding and centering portion 25 and/or of the supporting surface 21 is preferably effected by means of beam, fusion or laser welding.

What is claimed is:

1. A lightweight valve comprising:

a valve stem;

a hollow valve cone with a hollow space having an end of greater diameter, the end having an inner circumference, an outer circumference and an end face between the inner circumference and the outer circumference; and a valve disk closing the hollow space on one side and having a flat side facing the valve cone;

the valve stem being connected to a stem connection element formed on or fastened to the valve disk;

a valve cone support located at a distance from the valve disk and provided in the hollow space, the valve cone support being located on the stem connection element and projecting above the flat side; and the valve disk having a longitudinal portion extending from the flat side of the valve disk, the flat side of the valve disk and the longitudinal portion defining a recess serving as a centering or supporting seat for receiving the end of greater diameter of the valve cone, the valve disk including a step extending upward from the flat side of the valve disk, the step including an angled surface that is angled with respect to the flat side of the valve disk, the angled surface supporting the inner circumference of the end of greater diameter of the valve cone, the longitudinal portion supporting the end face of the end of greater diameter of the valve cone, the longitudinal portion being frustoconical and a having a cone angle that is the same as a cone angle of the valve cone at the end of greater diameter such that a continuous transition is brought about in a connection region between the longitudinal portion and the end of greater diameter of the valve cone;

wherein the valve cone includes an end of smaller diameter extending axially as a tubular projection to contact the stem connection element, the tubular projection having a reduced thickness in relation to a remainder of the cone so that the tubular projection nestles against the stem connection element.

2. The lightweight valve as claimed in claim 1 wherein the valve cone support includes at least one supporting surface bearingly contacting an inner wall region of the valve cone.

3. The lightweight valve as claimed in claim 2 wherein a contour of the supporting surface complements the inner wall region.

4. The lightweight valve as claimed in claim 1 wherein the valve cone-support is formed by a thickening on the stem connection element.

5. The lightweight valve as claimed in claim 1 wherein the valve cone is of disk-spring-shaped design.

6. The lightweight valve as claimed in claim 1 wherein the valve cone-support forms a centering or supporting seat for the valve cone.

7. The lightweight valve as claimed in claim 1 wherein the valve is an internal combustion engine valve.

8. The lightweight valve recited in claim 1 wherein the stem connection element includes a taper receiving the tubular projection such that a continuous transition is formed between the tubular projection and the stem connection element.

9. The lightweight valve recited in claim 1 wherein the valve cone, the valve disk and the valve stem are shaped such that the valve cone is slidable over the valve stem so the end face of the end of greater diameter of the valve cone is brought into contact with the longitudinal portion of the valve disk after the valve disk is connected to the valve stem.

10. The lightweight valve recited in claim 9 wherein the longitudinal portion of the valve disk and the end face of the end of greater diameter of the valve cone are shaped to come into contact without forming a connection.

11. The lightweight valve recited in claim 9 wherein the stem connection element is arranged on the valve disk to fix a vertical position of the valve cone relative to the valve disk as the end face of the end of greater diameter of the valve cone is brought into contact with the longitudinal portion of the valve disk.

12. The lightweight valve recited in claim 1 wherein the valve cone, the valve disk and the stem connection element are shaped such that the valve cone is slidable over the stem connection element so the end face of the end of greater diameter of the valve cone is brought into contact with the longitudinal portion of the valve disk after the valve disk is connected to the stem connection element.

13. The lightweight valve recited in claim 1 wherein the valve disk and the stem connection element are made from intermetallic phase titanium aluminide or a titanium aluminide alloy.

14. The lightweight valve recited in claim 1 wherein the outer circumference of the end of greater diameter of the valve cone does not contact the valve disk.

15. The lightweight valve recited in claim 1 wherein the valve cone, the valve disk and the stem connection element are shaped such that the valve cone, the valve disk and the stem connection element are alignable with each other before the valve cone, the valve disk and the stem connection element are materially connected.

* * * * *